US005749518A

United States Patent [19]

Wang

[11] Patent Number: 5,749,518

[45] Date of Patent: May 12, 1998

[54] ADJUSTABLE MULTI-PATTERN MINIATURE FOUNTAIN SPRINKLER

[75] Inventor: Yulis Wang, Taipei, Taiwan

[73] Assignee: Eiko Electric Products Corp., Taipei, Taiwan

[21] Appl. No.: 651,959

[22] Filed: May 21, 1996

[51] Int. Cl.[6] ..... B05B 17/08

[52] U.S. Cl. ..... 239/17; 239/443; 239/538; 239/552

[58] Field of Search ..... 239/16, 17, 436, 239/437, 443, 537, 538, 540, 548, 552, 553.5, 569, 581.1, 589, 590.5

[56] References Cited

U.S. PATENT DOCUMENTS

| | | | |
|---|---|---|---|
| 3,307,787 | 3/1967 | Hall, Jr. | 239/17 |
| 3,558,054 | 1/1971 | Ragul | 239/17 |
| 3,820,716 | 6/1974 | Bauer | 239/17 X |

FOREIGN PATENT DOCUMENTS

| | | | |
|---|---|---|---|
| 3900124 | 7/1989 | Germany | 239/17 |

*Primary Examiner*—Lesley D. Morris
*Attorney, Agent, or Firm*—Bacon & Thomas

[57] ABSTRACT

An adjustable multi-pattern miniature fountain sprinkler including a base, adjusting mechanisms, and a cover. The base is connected to a water duct disposed at a bottom side thereof. A plurality of water holes are formed in the bottom side of the base. The adjusting mechanisms consists of an upper adjusting seat and a lower adjusting seat coupled together and fitted within the base. The adjusting seats respectively have a bottom surface provided with a central hole which extends outwardly to form sector-like holes. The cover consists of a cover plate and a stem extending from a bottom side of the cover plate. The stem is fitted through the central holes of the respective adjusting seats. The cover plate has a peripheral rim provided with a multiplicity of inclined indentations adapted for providing a spray of water of multiple water levels and water patterns.

4 Claims, 5 Drawing Sheets

ADJUSTABLE MULTI-PATTERN MINIATURE FOUNTAIN SPRINKLER

BACKGROUND OF THE INVENTION (a) Field of the Invention

The present invention relates generally to a miniature fountain sprinkler, and more particularly to a miniature fountain sprinkler adapted for use in gardens or the like places for creating various visual effects.

(b) Description of the Prior Art

In conventional fountains, in order to create varied visual effects and achieve control of the water flow, it is often necessary to make use of complicated and huge sprinkler structures. The overall cost is therefore high. Such conventional fountain sprinklers are obviously not suitable for use in small gardens. At present, it is only possible to arrange a stream of water or a flow of water in garden scenes; it is difficult to create a spring of water in small gardens.

SUMMARY OF THE INVENTION

Accordingly, a primary object of the present invention is to provide an adjustable fountain sprinkler device for creating varied visual effects and patterns.

In order to achieve the above-mentioned object of the present invention, a preferred embodiment of the fountain sprinkler device essentially comprises a base having a water duct pre-disposed therein, an adjusting means fitted onto the base, a cover consisting of a cover plate and a stem extending from a bottom side of the cover plate for covering the adjusting means, the cover plate having peripheral inclined teeth, the cover plate having a central hole, thereby when water is conducted through the fountain sprinkler, it may be forced out through the central hole and from amongst the inclined teeth of the cover plate to create multifarious visual effects, and by means of controlling the adjusting means, the amount of water may be adjusted.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENTS

Figure 1:
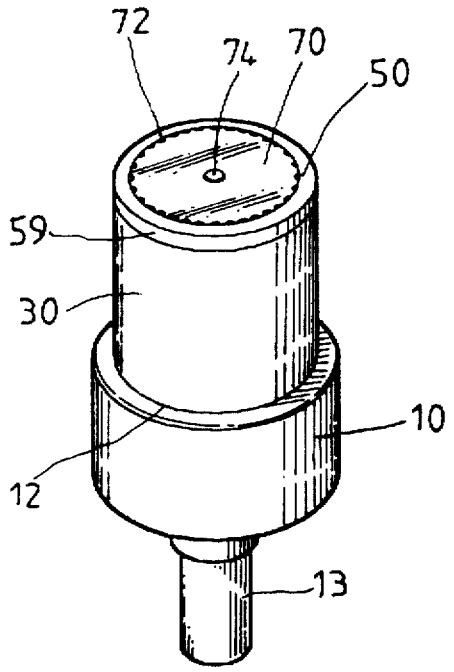
FIG. 1 is an elevational view of a preferred embodiment of the fountain sprinkler of the present invention.
Figure 2:
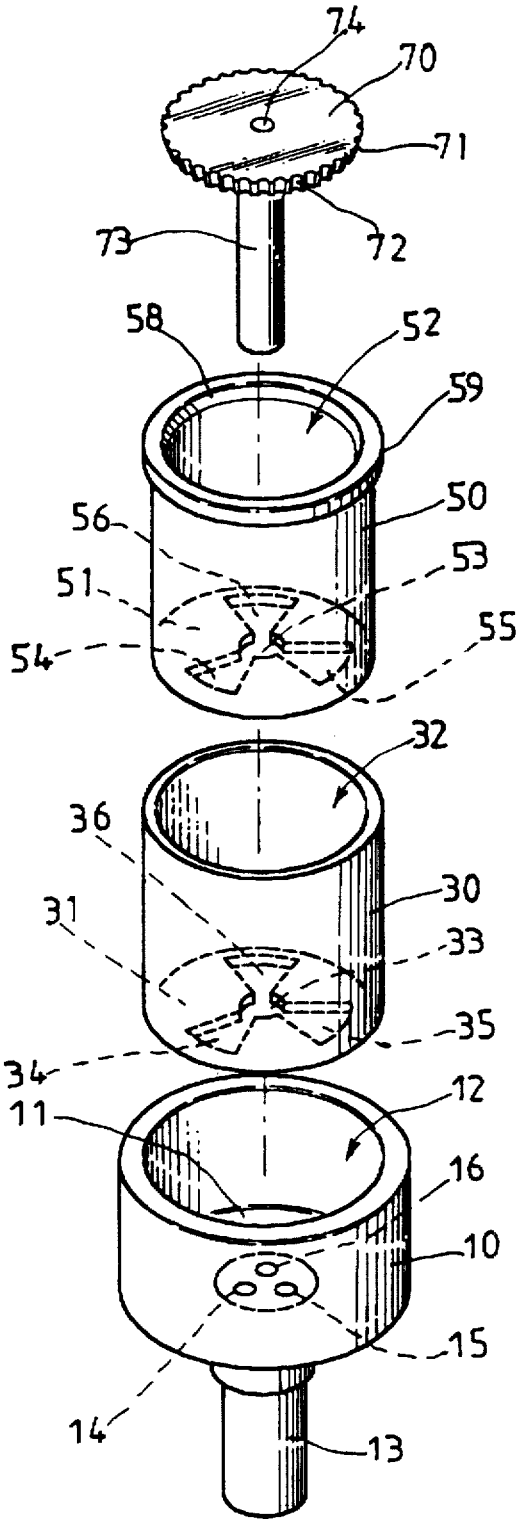
FIG. 2 is an elevational, exploded view of the fountain sprinkler shown in FIG. 1.

With reference to FIGS. 1 and 2, a preferred embodiment of the fountain sprinkler according to the present invention essentially comprises a base 10, a lower adjusting seat 30, an upper adjusting seat 50 and a cover 70.

The base 10 has a suitable diameter and is provided with an inner hole 12 with a bottom surface 11. A water duct 13 is connected to the bottom surface 11 from below the base 10. Separate water holes 14, 15 and 16 are preferably arranged at the bottom surface 11.

The lower adjusting seat 30 may be disposed into the inner hole 12 of the base 10. The lower adjusting seat 30 has a suitable diameter such that it may fit tightly into the inner hole 12. A bottom surface 31 is also provided at the lower adjusting seat 30 which has an inner receiving hole 32. A central hole 33 is provided at the bottom surface 31. The central hole 33 extends outwardly in the shape of the blades of a fan to form sector-like holes 34, 35 and 36 for matching the water holes 14, 15 and 16 at the bottom surface 11 of the base 10.

The upper adjusting seat 50 is shaped to match the lower adjusting seat 30 and has a smaller diameter so that it may fit into the inner receiving hole 32 of the lower adjusting seat 30. A flange 59 is provided at an upper rim of the adjusting seat 50 for positioning purposes. Obviously, the upper adjusting seat 50 may be provided with a bottom surface 51, an inner hole 52 having a slightly flared portion 58 near the upper rim, and a central hole 53 as well as multiple sector-like holes 54, 55 and 56 at the bottom surface 51.

The cover 70 consists of a cover plate and a stem 73 extending from the center of a bottom side of the cover plate. The cover plate is provided with a toothed periphery 71 inclining inwardly to match the flared portion 58 of the upper adjusting seat 50 so that the cover 70 may be properly fitted into the inner hole 52 of the upper adjusting seat 50. The periphery 71 is provided with tooth-like indentations 72. The stem 73 has a suitable length and a central hole 74. The stem 73 may be fitted through the respective central holes 53 and 33 of the respective bottom surfaces 51 and 31 of the adjusting seats 50 and 30. The cover 70, the upper adjusting seat 50 and the lower adjusting seat 30 may be welded together by using high frequency oil to ensure that the adjusting seats 30 and 50 are rotatable.

Figure 3:
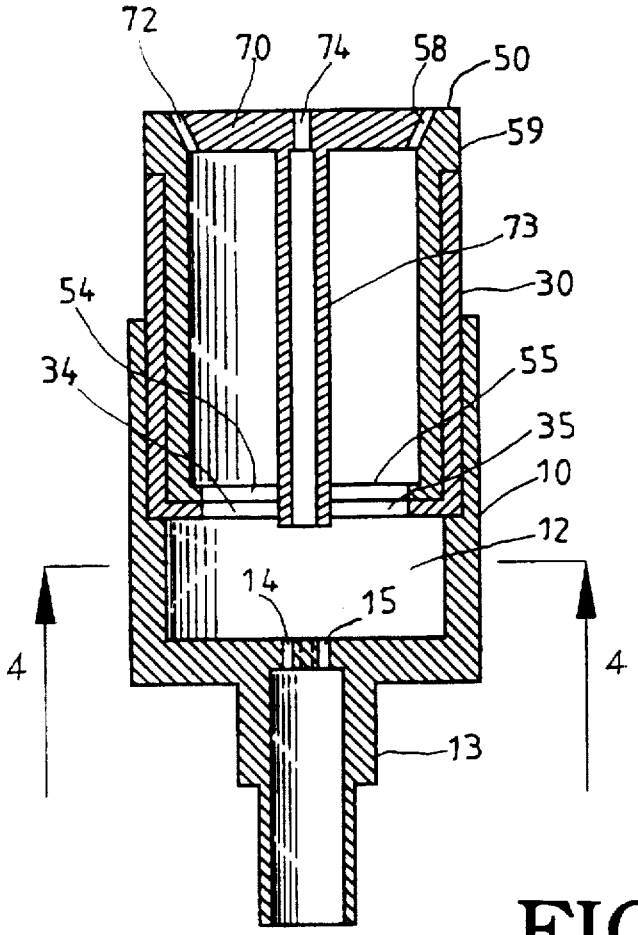
FIG. 3 is a sectional view of the fountain sprinkler in an assembled state.
Figure 5:
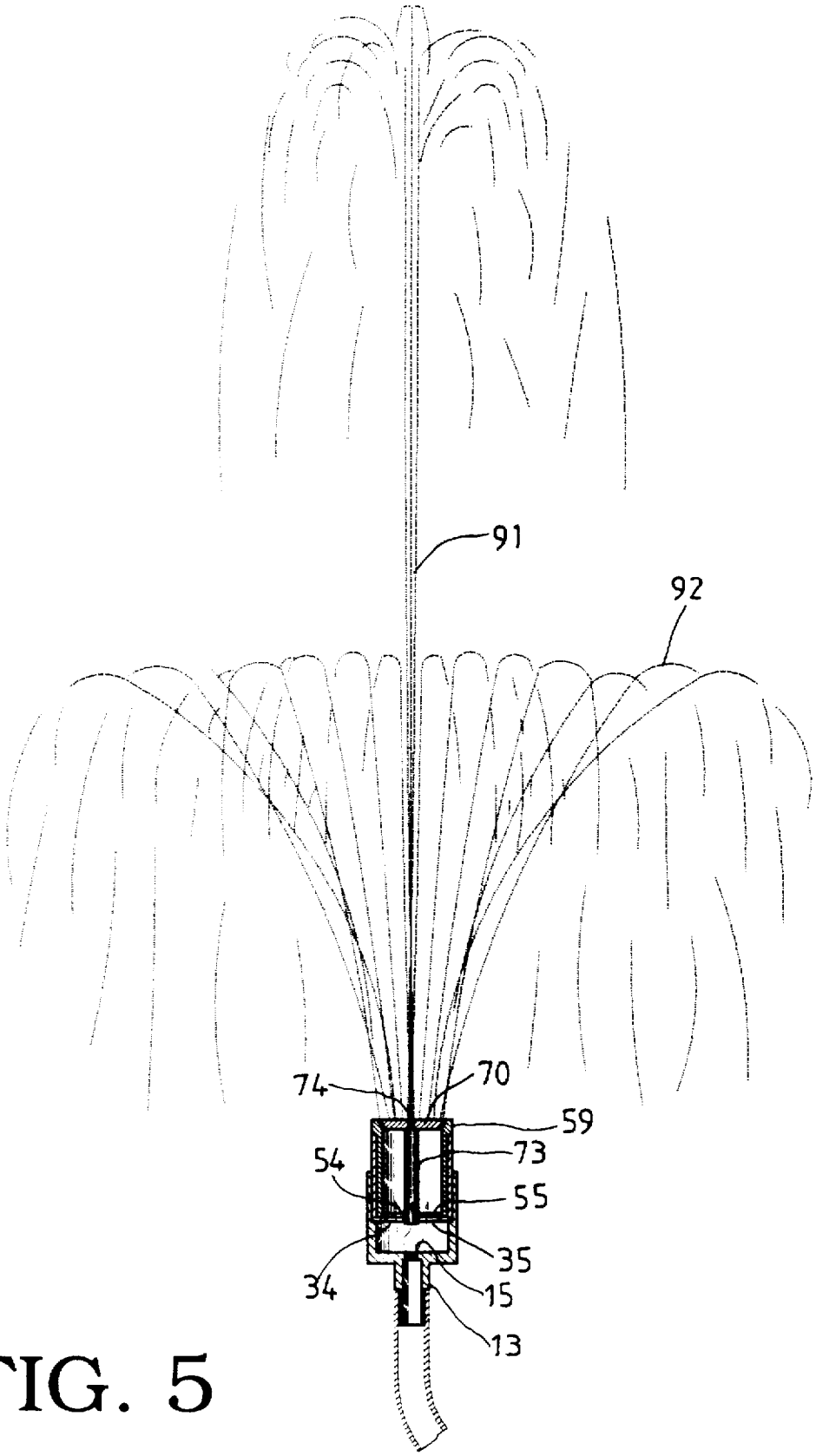
FIG. 5 is a schematic view illustrating a fountain created by using the fountain sprinkler of the present invention.

With reference to FIGS. 3 and 5, when water is supplied into the water duct 13, it will pass through the water holes 14, 15 and 16 and will be forced out through the central hole 74 of the cover 70, the sector-like holes 34, 35 and 36 of the lower adjusting seat 30 and the sector-like holes 54, 55 and 56 of the upper adjusting seat 50 as well as indentations 72 of the cover 70, forming a jet 91 of water at the center and a radial screen of water 92 at a lower level.

Figure 4:
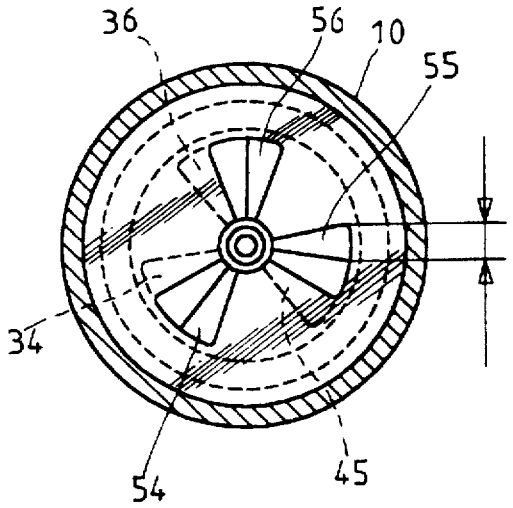
FIG. 4 is a cross-sectional view taken along line 4—4 of FIG. 3.

Referring to FIGS. 2 and 4, as the adjusting seats 30 and 50, which are fitted together such that the sector-like holes 34, 35, 36, 54, 55 and 56 overlap, they may be turned to adjust the overlapping relationship of their sector-like holes so as to control the amount of water coming out therethrough. By means of this arrangement, the pattern of the radial screen of water at the lower level of the fountain may be varied.

Figure 6:
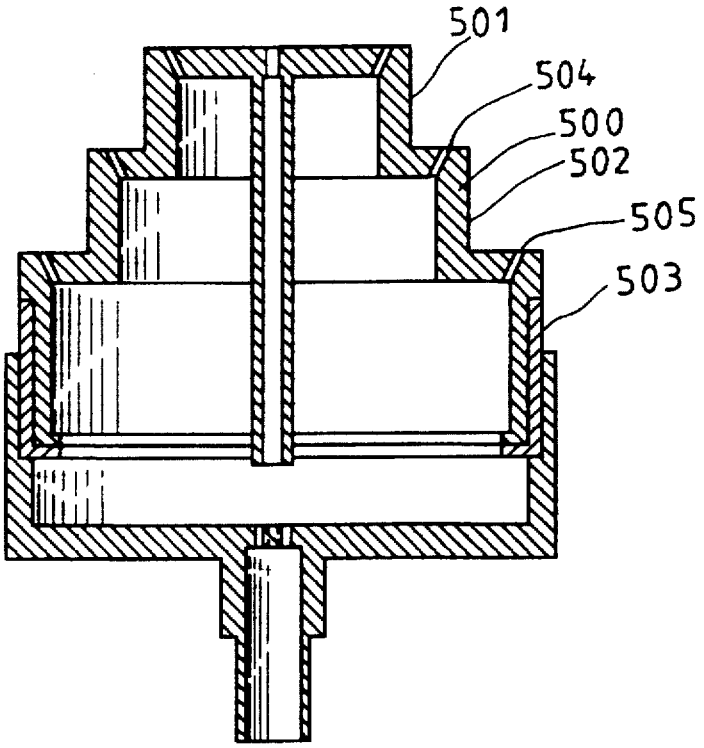
FIG. 6 is a schematic view of another preferred embodiment of the fountain sprinkler of the present invention.

FIG. 6 shows another preferred embodiment of the fountain sprinkler of the present invention. In this preferred embodiment, an upper adjusting seat 500 is configured to have a plurality of steps 501, 502 and 503. A plurality of inclined holes 504 and 505 are provided in the respective peripheral rims of the steps 501, 502 and 503 to achieve a radial screen of water 92 of various steps. It should be understood that the shapes of the respective water holes of the components of the fountain sprinkler of the invention may be configured to be circular, quadrilateral, triangular and so forth to achieve multifarious fountain effects. Additionally, the number of steps of the adjusting seats of the fountain sprinkler may be increased as desired.

In summary, the fountain sprinkler of the invention may, by means of the adjusting seats, control the amount of water ejected and the pattern of the fountain effects to provide greater variety to garden scenes.

Although the present invention has been illustrated and described with reference to the preferred embodiment thereof, it should be understood that it is in no way limited to the details of such embodiment but is capable of numerous modifications within the scope of the appended claims.

What is claimed is:

1. An adjustable miniature fountain sprinkler, comprising a base having a bottom surface, a water duct connected to said bottom surface of said base with a plurality of water holes disposed therebetween; adjusting means consisting of an upper adjusting seat and a lower adjusting seat fitted together and disposed within an inner hole of said base, said upper adjusting seat and said lower adjusting seat respectively having an inner hole and a bottom surface provided with a central hole which extends outwardly to form sector-like holes; and a cover consisting of a cover plate and a stem, said cover being fitted onto said upper adjusting seat such that said stem extends downwardly through the respective central holes of said upper adjusting seat and said lower adjusting seat, said cover plate being provided with a multiplicity of inclined indentations at its peripheral rim.

2. The fountain sprinkler as claimed in claim 1, wherein said upper adjusting seat is provided with a flange at an upper rim thereof so that it may fit into said lower adjusting seat and be positioned therein.

3. The fountain sprinkler as claimed in claim 1, wherein said upper adjusting seat is provided with a flared portion at an upper end thereof for matching the peripheral rim of said cover plate, said inclined indentations at the peripheral rim of said cover plate allow water to pass therethrough to form a radial screen of water.

4. The fountain sprinkler as claimed in claim 1, wherein said adjusting means is stepped.

* * * * *